United States Patent [19]

Moffet et al.

[11] 4,298,572

[45] Nov. 3, 1981

[54] MUD LOGGING SYSTEM

[75] Inventors: John N. Moffet; John D. Moffet, both of Wichita Falls; David L. Ragsdill, Arlington, all of Tex.

[73] Assignee: Energy Detection Company, Wichita Falls, Tex.

[21] Appl. No.: 125,241

[22] Filed: Feb. 27, 1980

[51] Int. Cl.[3] ..... G01N 33/24; G01N 7/14

[52] U.S. Cl. ..... 422/68; 23/230 EP; 73/153; 346/33 WL; 422/81

[58] Field of Search ..... 73/153; 299/19; 166/336; 23/230 EP; 422/68, 81; 346/33 WL

[56] References Cited

U.S. PATENT DOCUMENTS 2,714,308 8/1955 Heck ..... 346/33 WL 2,749,748 6/1956 Slobod et al. ..... 73/153

2,883,856 4/1959 Youngman ..... 73/153 X

*Primary Examiner*—Ronald Serwin

*Attorney, Agent, or Firm*—Richards, Harris & Medlock

[57] ABSTRACT

A system (10) for continuously analyzing drilling mud circulating through a borehole comprises a sampling chamber (12) through which flows the return mud, a sensor (16) mounted in the sampling chamber for detecting hydrogen gas percolating out of the drilling mud and for producing a signal representative of the concentration of hydrogen, and a recorder (34) for recording the signal from the sensor over a period of time. Appropriate circuitry within a control panel (20) is connected between the sensor (16) and recorder (34). In the preferred embodiment of the invention, the recorder (34) comprises a clock driven disk recorder.

5 Claims, 5 Drawing Figures

MUD LOGGING SYSTEM

TECHNICAL FIELD

The present invention relates in general to a system for analyzing drilling mud circulated through a borehole during drilling. More particularly, this invention involves a system for continuously sensing and recording the relative concentration of hydrocarbon gases associated with cutings carried by the drilling mud.

BACKGROUND ART

In drilling oil or gas wells, mud-laden fluid or "drilling mud" is typically circulated through the borehole to cool and lubricate the drill bit, and to remove cuttings from the hole. The drilling mud is pumped into the hole from a nearby surface pond or pit, and is returned to the pit to deposit the various cuttings carried by the mud before recirculation through the hole.

The drilling mud provides a means of communicating with the bottom of the hole and with the geological formations penetrated by the drill bit. By appropriate measurements at the surface, before the mud is returned to the pit, useful data such as the concentration of oil, gas, water or sulfur in the drilling mud and cuttings, rate of drilling penetration, etc. can be determined through mud analysis. Such data can then be correlated with drilling depth to provide a log of useful information.

Examination of drilling mud and the cuttings carried thereby is known as mud logging. Although batch samples of drilling mud can be collected and analyzed, it is preferable to conduct sampling on a continuous basis. Continuous sampling is generally faster and more accurate than batch sampling. The control and amount of information afforded by continuous mud logging is particularly desirable when drilling exploratory holes, for instance, or when the stratigraphy is complicated.

While mud logging systems have been developed heretofore, the systems of the prior art have tended to be complex, expensive and difficult to operate. Most if not all of the prior systems for logging drilling mud on a continuous basis have required the attention of at least one operator. For example, one system of the prior art is truck-mounted and operator-attended, and consumes a large amount of power. The drilling mud is sampled inside the truck, which is usually parked a substantial distance away from the borehole due to the various drilling equipment which must be located around the hole. By the time the drilling mud reaches the truck, it may have become stale by percolation of gases out of solution, thereby reducing reliability and accuracy of the sampling. In addition, the expense of operating and maintaining such mud logging systems has made it infeasible to drill some exploratory holes that otherwise might have been drilled.

A need has thus arisen for a simplified mud logging system for analyzing the hydrocarbon content of drilling mud on a continuous basis with very little operator attention, except to activate the system and change the disk of a chart recorder at periodic intervals.

SUMMARY OF THE INVENTION

The present invention comprises a mud logging system which overcomes the foregoing and other difficulties associated with the prior art. In accordance with the invention, there is provided a mud logging system of simplified and inexpensive construction. The system herein utilizes a clock-driven, chart recorder to log the relative concentrations of hydrocarbons detected in drilling and returning from the borehole over an extended period without operator attention.

More particularly, the mud logging system herein comprises a sampling chamber, a hydrocarbon sensor mounted in the sampling chamber, and a recorder connected to the sensor through appropriate circuitry. The sampling chamber is adapted for connection to the drilling mud return line between the borehole and mud pit. As the drilling mud flows through the sampling chamber, any hydrocarbon gases associated with the cuttings carried by the mud separate from the mud for detection by the sensor. The recorder provides a continuous log of the relative concentration of hydrocarbons in the drilling mud over a predetermined period, such as twenty four hours, for correlation with drilling depth to locate production zones.

BRIEF DESCRIPTION OF DRAWINGS

A more complete understanding of the invention can be had by reference to the following Detailed Description together with the accompanying Drawings, wherein.

DETAILED DESCRIPTION

Figure 1:
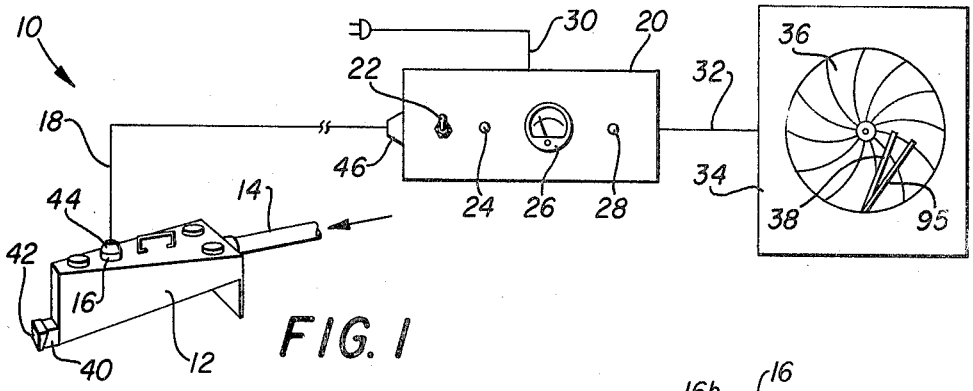
FIG. 1 is a schematic diagram of a mud logging system incorporating the invention.

Referring now to the Drawings, wherein like reference numerals designate like or corresponding parts throughout the views, and particularly referring to FIG. 1, there is shown a mud logging system 10 incorporating the invention. System 10 includes a flow or sampling chamber 12 connected via pipe 14 to the return line of a mud circulation system (not shown) for a borehole. Drilling mud and borehole cuttings carried thereby pass through chamber 12 before return to the mud pit, from which the drilling mud is continuously circulated through the borehole during drilling. Chamber 12 defines a separation chamber within which any hydrocarbons associated with the cuttings in the drilling mud can be detected by a sensor 16 mounted in the top of the chamber. A line 18 connects sensor 16 with a control panel 20 situated in the doghouse or at some other location remote from sampling chamber 12. Control panel 20 includes a power on/off switch 22, an on/off lamp 24, a voltmeter 26, and a warning lamp 28. Power for system 10 is provided by a cord 30 which includes a plug for connection to a 110 volt AC outlet. Control panel 20 is connected by line 32 to a recorder 34 which includes a clock-driven chart 36 and a movable pen 38. In the preferred construction, control panel 20 and recorder 34 are housed in a common case.

Recorder 34 is responsive to a voltage signal via the circuitry within control panel 20 in accordance with the relative concentration of hydrocarbons detected by sensor 16. As the drilling mud flows through sampling chamber 12, any hydrocarbons which percolate out of solution within the chamber are continuously detected by sensor 16 and charted on recorder 34, as will be more fully explained hereinafter.

Figure 2:
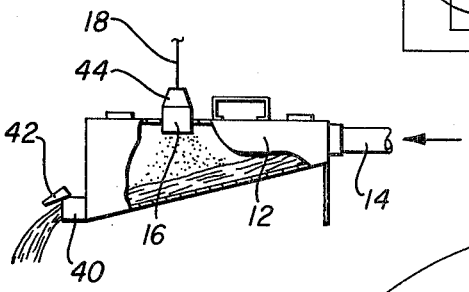
FIG. 2 is a side view (partially cutaway) of the sampling chamber of the system.

FIG. 2 illustrates sensor 16 mounted in the top wall of sampling chamber 12. Any sampling chamber of suitable construction can be utilized with system 10; however, in accordance with the preferred embodiment, sampling chamber 12 corresponds to the chamber disclosed and claimed in copending application Ser. No. 115,002, filed Jan. 24, 1980, and assigned to Energy Detection Company. Chamber 12 is preferably generally triangular in longitudinal cross section, and generally rectangular in lateral cross section. The back wall of chamber 12 includes a fitting for connection to pipe 14, while the front wall of the chamber includes an outlet 40 with a hinged trap door 42 thereon located below the inlet. Drilling mud entering chamber 12 slides down the declined bottom wall of the chamber and through outlet 40 for return to the mud pit. Any gas associated with cuttings carried within the drilling mud is thus allowed to percolate out of solution and collect within the upper portion of sampling chamber 12 for detection by sensor 16.

Figure 3:
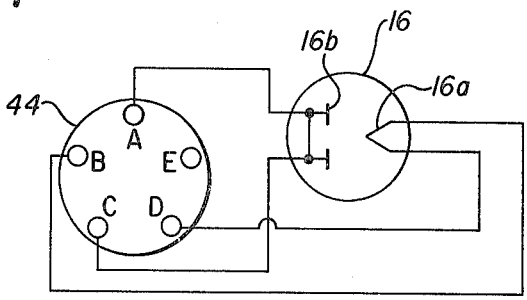
FIG. 3 is a schematic diagram of the sensor circuitry utilized in the invention.

The details of sensor 16 are best shown in FIG. 3. Sensor 16 comprises a conventional pass-through ionic sensor of the type utilized in smoke alarm systems. For example, the Figaro TGS-109 sensor has been found satisfactory for use as sensor 16. Sensor 16 is connected to a five pin plug 44 to which line 18 leading to control panel 20 is connected. Pins B and D of plug 44 are connected to the heated cathode 16*a* of sensor 16. Pins A and C of plug 44 are connected to the anode 16*b* of sensor 16. When a hydrogen-rich gas passes through the filament of sensor 16, the current flow from cathode 16*a* to anode 16*b* increases in accordance with the concentration of hydrogen in the gas to provide an indication of hydrocarbons.

Figure 4:
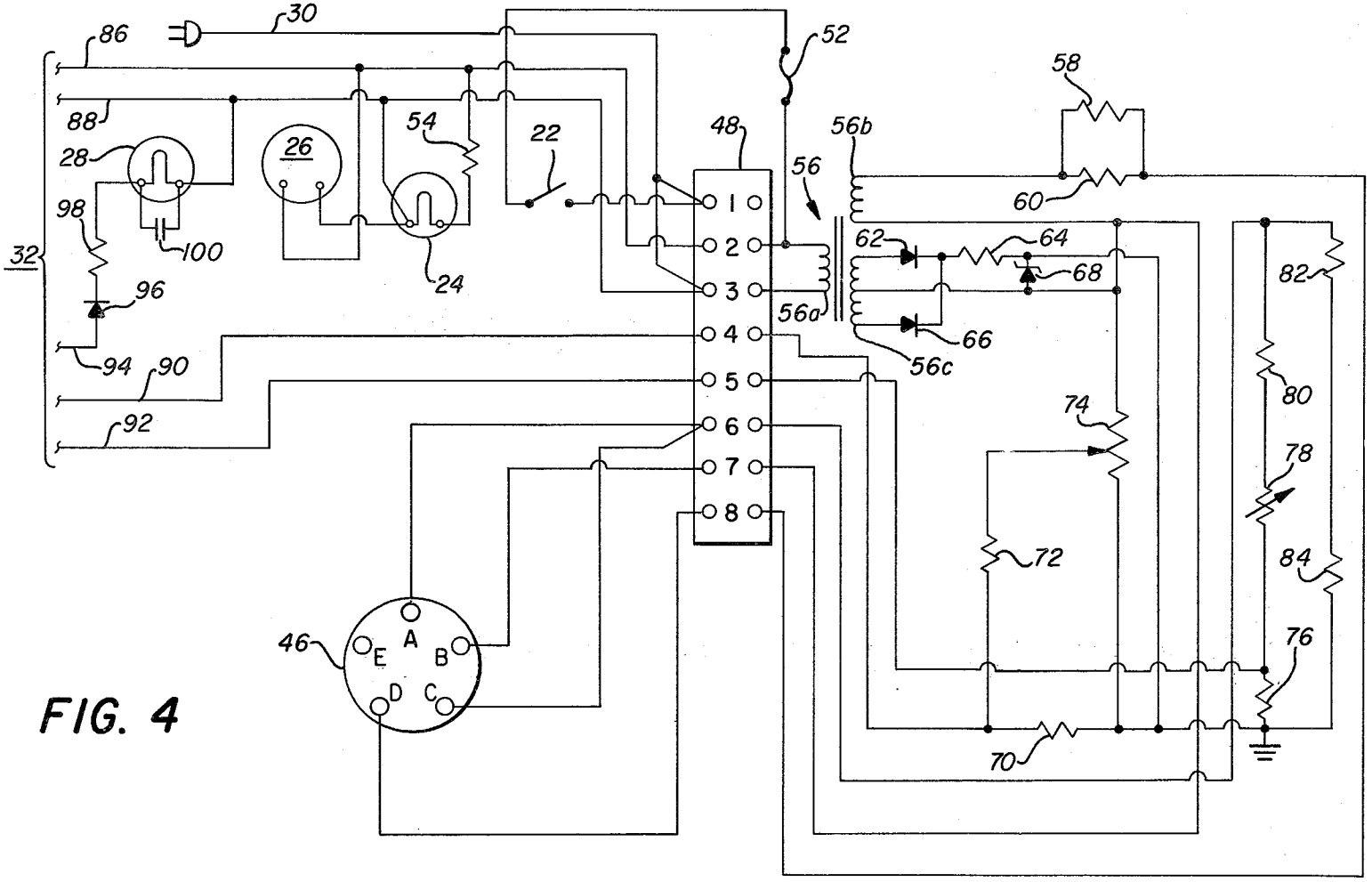
FIG. 4 is a schematic diagram of the control circuitry utilized in the invention.

Referring now to FIG. 4, there is shown the circuitry contained in control panel 20. Line 18, which is shown in FIG. 1, connects plug 44 on sampling chamber 12 to a five pin plug 46 on control panel 20. The pins of plug 44 are connected to their counterparts on plug 46. Pins A and C of plug 46 are connected to pin 6 of terminal board 48, while pin B of the plug is connected to pin 7 of the terminal board and pin D of the plug is connected to pin 8 of the terminal board. It will be understood that the pins located on either side of each of the numerals 1–8 on terminal board 48 are connected together, but have been shown as separate pins for purposes of clarity.

The two leads of AC power cord 30 are connected to pins 1 and 3 of terminal board 48, while on/off switch 22 and fuse 52 are wired in series between pins 1 and 2. The on/off lamp 24 together with a resistor 54 are wired in series between pins 2 and 3 of terminal board 48. When switch 22 is closed, lamp 24 is energized to indicate that system 10 is on.

A transformer 56 is provided for converting 110 volt alternating current to two levels of direct current for use by sensor 16 and recorder 34. The primary terminals 56*a* of transformer 56 are connected to pins 2 and 3 of terminal board 48.

Transformer 56 includes a first set of secondary terminals 56*b* for providing a relatively low direct current voltage to sensor 16, and a second set of secondary terminals 56*c* for providing a relatively higher direct current voltage to recorder 34. A pair of resistors 58 and 60 are connected in parallel between the upper lead of first secondary terminal 56*b* and pin 8. The lower lead of first secondary terminal 56*b* is connected to pin 7. Pins 7 and 8 of terminal board 48, of course, are connected to cathode 16*a* of sensor 16.

A diode 62 and resistor 64 are connected in series between the upper lead of the second set of secondary terminals 56*c* and ground. Another diode 66 is connected between the lower lead of the second set of secondary terminals 56*c* and the junction between diode 62 and resistor 64. A zener diode 68 is connected between ground and the center tap of terminals 56*c*, which is also connected to the lower lead of the first set of secondary terminals 56*b*. A variable resistor 74 is connected between the center tap of secondary terminals 56*c* and ground. A resistor 70 is connected between pin 4 and ground and a resistor 72 is connected between the wiper of variable resistor 74 and pin 4. The variable resistor 74 provides for adjustment of the current flow to sensor 16 to vary the temperature thereof. A resistor 76 is connected between pin 5 and ground. Variable resistor 78 and resistor 80 are connected in series between pins 5 and 6. Resistors 82 and 84 are connected in series between pin 6 and ground. Resistors 78–84 provide signal conditioning and adjustment for the sensor signal which is transmitted to recorder 34.

Looking now at the left side of FIG. 4, line 32 interconnecting control panel 20 and recorder 34 is comprised of five leads 86, 88, 90, 92 and 94. Leads 86 and 88 which carry the alternating current to power recorder 34 are connected to pins 2 and 3, respectively, of terminal board 48. Lead 90, which carries the negative reference voltage for the sensor signal to ride on, is connected to pin 4. Lead 92 connected to pin 5 carries the conditioned signal from sensor 16. Lead 94 is connected to an internal threshold detector within recorder 34, which applies a voltage to energize the warning lamp 28 when a predetermined threshold, as set by arm 95 (FIG. 1) on recorder 34. has been exceeded. Diode 96, resistor 98 and capacitor 100 comprise a relaxation oscillator network causing lamp 28 to flash when a voltage is applied to lead 94.

Figure 5:
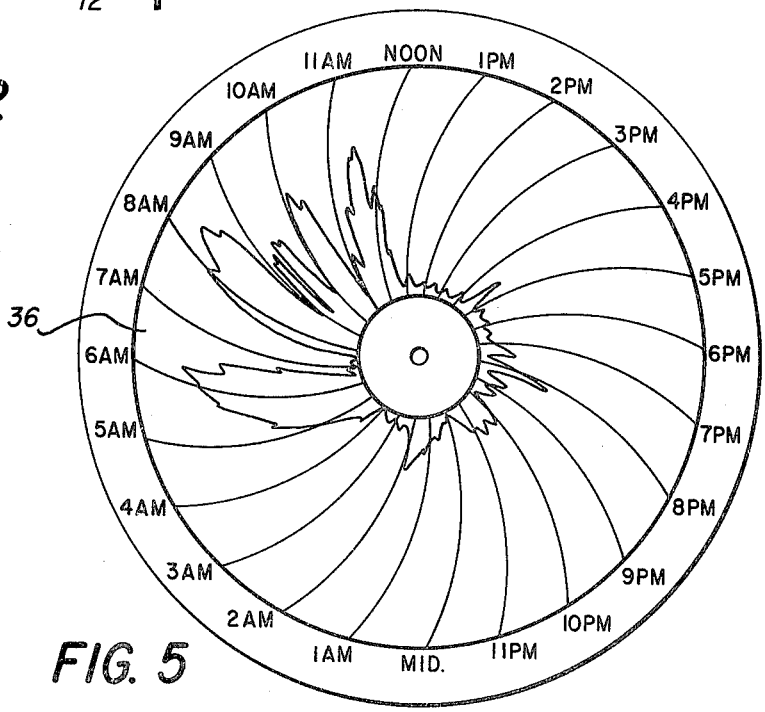
FIG. 5 is an enlarged view of a portion of a chart recorded with the system.

Referring now to FIG. 5 in conjunction with FIG. 1, recorder 34 is preferably a twenty four hour, clock-driven unit. Any suitable recorder can be utilized, such as the Model ET recorder available from Partlow Corporation of New Hartford, N.Y. FIG. 5 illustrates a portion of a mud log recorded on chart 36 of recorder 34. Between the times of 1:00 p.m. and 4:00 a.m., it will be noted that the tracing on chart 36 is relatively close to the center of the chart, thus indicating little or no hydrocarbons in the formations penetrated by the drill bit at that time. On the other hand, a high concentration of hydrocarbons would appear to be present in the particular formations traversed between the times of 5:30–6:30 a.m. and 7:30–8:30 a.m. as indicated by the large deflections in the tracing made by pen 38. In correlating the information on chart 36 with drilling depth, of course, it will be necessary to allow for the lag time required for the drilling mud to travel from the bottom of the borehole to sampling chamber 12.

In view of the foregoing, it will be apparent that the present invention comprises a new and improved mud logging system having several advantages over the prior art. The system herein features simplified construction and requires no operator attention other than to turn on and adjust the system, and to periodically change the chart of the recorder. With the system herein, it becomes economically feasible to drill and log some exploratory holes which would be too costly with the complicated systems of the prior art. Other advantages will be apparent to those skilled in the art.

Although particular embodiments of the invention have been illustrated in the accompanying Drawings and described in the foregoing Detailed Description, it will be understood that the invention is not limited to the specific embodiments disclosed, but is intended to embrace any alternatives, equivalents, modifications, and rearrangements of elements as fall within the scope of the invention as defined by the following Claims.

We claim:

1. Apparatus for automatically and continuously analyzing hydrogen gas associated with drilling mud circulated through a borehole, which comprises:

a sampling chamber having front and back ends, and top and bottom sides;

an inlet in said front end of said sampling chamber for receiving drilling mud from the borehole;

an outlet in said back end of said sampling chamber for returning drilling mud to the borehole;

said sampling chamber having a rectangular cross-sectional shape, increasing in width and decreasing in height from said back end of said sampling chamber to said front end thereof, such that said bottom wall is inclined relative to said top wall of said sampling chamber to thereby facilitate the unobstructed flow of drilling mud from said inlet to said outlet of said sampling chamber and percolate the hydrogen gas out of the drilling mud;

sensing means mounted in said sampling chamber for continuously sensing the concentration of hydrogen gas present in said sampling chamber and associated with the drilling mud as the drilling mud flows through said sampling chamber, said sensing means generating a signal representative of said concentration of hydrogen gas; and recording means coupled to said sensing means for automatically receiving said signal generated by said sensing means to thereby record said concentration of hydrogen gas over a predetermined period of time associated with the drilling mud flowing through said sampling chamber.

2. The apparatus of claim 1 wherein said outlet is disposed at a point below said inlet.

3. The apparatus of claim 1 wherein said sensing means includes a heated filament which produces ionic conduction as hydrogen gas passes through said sensing means.

4. The apparatus of claim 1 wherein said recording means includes clock-driven chart recording means.

5. The apparatus of claim 1 wherein said sensing means is mounted in said top side of said sampling chamber.

* * * * *